United States Patent [19]

Spamer et al.

[11] Patent Number: 4,706,820

[45] Date of Patent: Nov. 17, 1987

[54] GRAVITY FEED SHELF FOR STORE GONDOLAS

[75] Inventors: William S. Spamer, Roswell; David S. Leverette, Hartwell, both of Ga.

[73] Assignee: The Mead Corporation, Dayton, Ohio

[21] Appl. No.: 920,214

[22] Filed: Oct. 17, 1986

[51] Int. Cl.[4] ..... A47F 7/00

[52] U.S. Cl. ..... 211/59.2; 211/183; 211/182

[58] Field of Search ..... 211/59.2, 190, 72, 187, 211/90, 182, 189, 183, 133, 186; 248/220.2, 222.1, 224.4, 916; 403/242, 245; 108/144, 111

[56] References Cited

U.S. PATENT DOCUMENTS

| | | | |
|---|---|---|---|
| 1,975,622 | 10/1934 | Schermerhorn | 211/183 X |
| 3,142,386 | 7/1964 | Skubic | 211/182 |
| 3,556,306 | 1/1971 | Shell | 211/182 X |
| 3,587,867 | 6/1971 | Fenwick | 211/183 |
| 3,867,047 | 2/1975 | Wightman et al. | 403/242 |
| 4,317,523 | 3/1982 | Konstant | 211/182 X |
| 4,342,397 | 8/1982 | Halstrick | 211/182 X |

FOREIGN PATENT DOCUMENTS

| | | | |
|---|---|---|---|
| 446646 | 3/1968 | Switzerland | 211/190 |

*Primary Examiner*—Ramon S. Britts
*Assistant Examiner*—Sarah A. Lechok Eley
*Attorney, Agent, or Firm*—Rodgers & Rodgers

[57] ABSTRACT

A gravity feed shelf includes a plurality of chutes mounted on a rectangular frame having front and rear cross supports interconnected at their ends with a pair of side supports, at least one corner junction between adjacent ends of the rear cross support and the side supports being formed by a slide connection to accommodate sidewise motion of the side supports relative to the rear cross support so that variations in the horizontal spacing between vertical support posts on which the shelf is mounted may be accommodated since the interconnection between these support posts and the shelf is via the rear ends of the side supports.

7 Claims, 5 Drawing Figures

GRAVITY FEED SHELF FOR STORE GONDOLAS

TECHNICAL FIELD

This invention relates to gravity feed shelves which are specially adapted for use in conjunction with store gondolas having horizontally spaced vertical upright posts on which the shelf is mounted.

BACKGROUND ART

U.S. Pat. Nos. 4,314,648 issued Feb. 9, 1982 and U.S. Pat. No. 4,454,948 issued June 19, 1984 as well as U.S. Pat. No. 4,565,725 issued Jan. 21, 1986 are all owned by the assignee of this invention and all are concerned with gravity feed shelves for use in conjunction with display stands commonly used in supermarkets for displaying items such as soft drinks and the like. Such devices are primarily intended for use in conjunction with display stands in which the vertical support posts are fixed in position with a substantially uniform horizontal spacing therebetween. Such inventions are not well adapted for accommodating variations in the horizontal spacing between support posts for gravity feed shelves.

DISCLOSURE OF THE INVENTION

According to this invention in one form, a display shelf includes front and rear cross supports the ends of which are interconnected with the ends of a pair of spaced side supports to form a rectangular frame structure on which a plurality of low friction chutes are mounted and wherein the rear cross support is interconnected at at least one end with the rear ends of the side supports by lost motion connections which include an inwardly projecting support panel mounted on each of the side supports adjacent the rear ends thereof together with a downwardly projecting tab formed at each end of the rear cross support and which is horizontally slidable within the transverse slot disposed within the support panel to accommodate horizontal movement of the side supports relative to the rear cross support so that fastening devices secured to the rear edges of the side supports may properly seat within openings formed in spaced apart vertical posts the spacing between which may vary somewhat.

BEST MODE OF CARRYING OUT THE INVENTION

Figure 1:
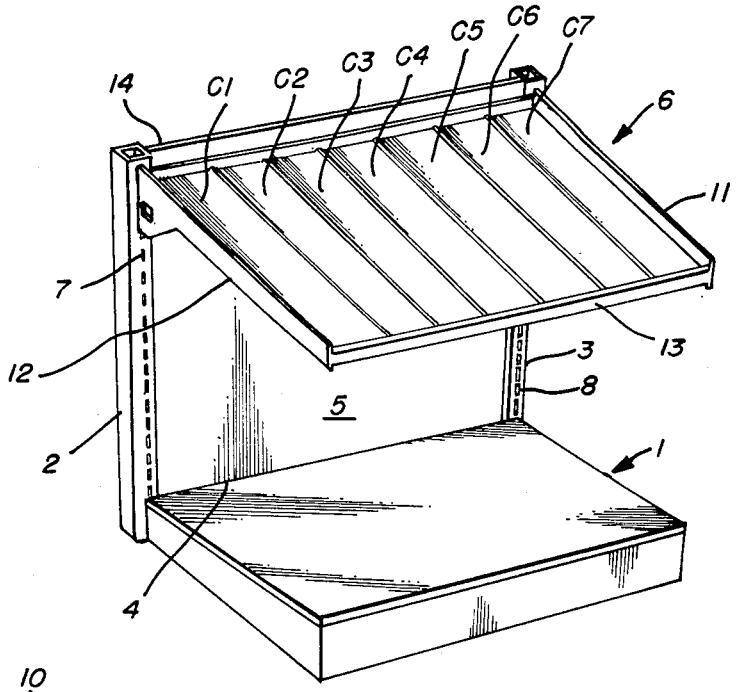
FIG. 1 is a perspective view of a gondola on which a shelf formed according to this invention is mounted.

In FIG. 1, the base of a gondola is generally designated by the numeral 1. Upright posts 2 and 3 are secured to the rear edge 4 of base 1 and a back 5 is secured to the posts 2 and 3. The shelf generally designated by the numeral 6 is constructed in accordance with this invention.

Posts 2 and 3 are provided with a plurality of vertically spaced apertures 7 and 8 respectively which are arranged to receive the positioning tabs such as 9 and the positioning hooks such as 10 which are formed along the rear edge of side supports 11 an 12. The front ends of side supports 11 and 12 are interconnected in known manner with a front cross support 13 and one or both rear ends of side supports 11 and 12 are interconnected with rear cross support 14 by lost motion connections formed according to this invention. This lost motion relationship between the rear ends of side supports 11 and 12 and the opposite ends of back cross support 14 is particularly applicable for use in conjunction with store gondolas since the spacing between uprights such as 2 and 3 may vary somewhat from unit to unit. Thus according to a main feature of this invention, the rear ends of side supports such as 11 and 12 may move horizontally relative to the rear cross support 14 thereby to accommodate variations in the horizontal spacing between vertical posts such as 2 and 3. A plurality of gravity feed chutes such as C1–C7 are mounted on the frame of shelf 6 and afford gravity feed of rows of products as is well known.

Figure 2:
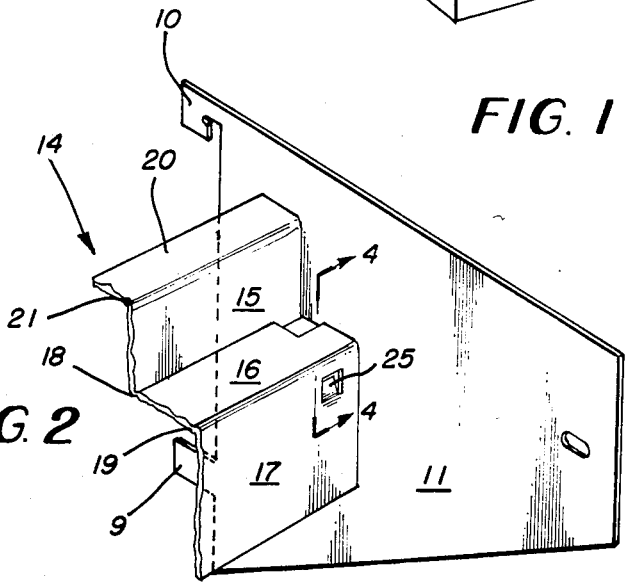
FIG. 2 is an enlarged perspective view of a corner junction between the rear end of one side support and one end of the rear cross support.
Figure 4:
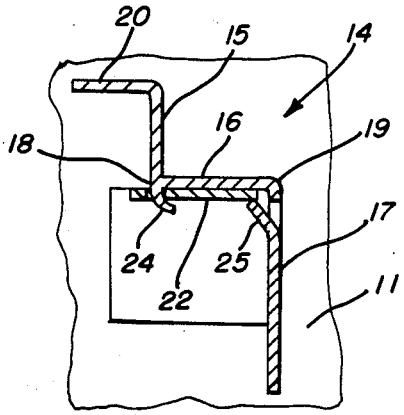
FIG. 4 is a cross sectional view taken along the line designated 4—4 in FIG. 2.
Figure 3:
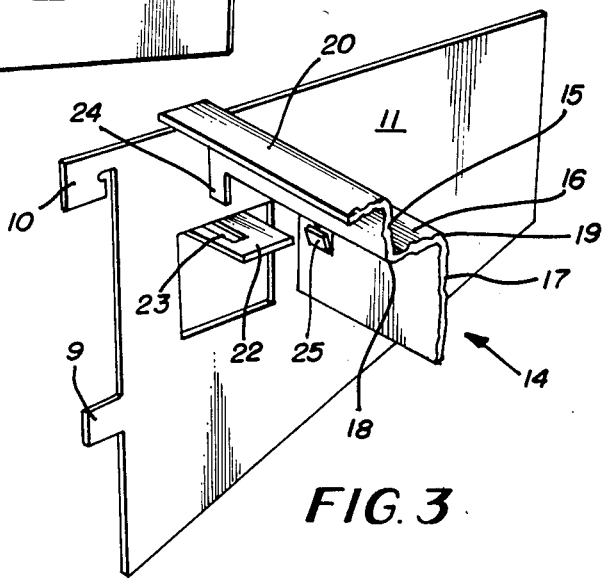
FIG. 3 is an exploded view of the structure shown in FIG. 2 and which is taken from a somewhat different vantage point.

As is apparent from FIGS. 2, 3 and 4, the rear cross support 14 is a stepped structure including a first transverse strip 15 which extends between side supports 11 and 12 and is disposed approximately in an imaginary vertical plane and a second transverse strip 16 which extends between side supports 11 and 12 and is disposed in an imaginary approximate horizontal plane. A third transverse strip 17 extends between side supports 11 and 12 and is disposed in an imaginary approximate vertical plane. Strip 16 is integrally formed at its rear edge 18 with the lower edge of strip 15 and at its forward edge 19 with the upper edge of vertically disposed horizontal strip 17. A horizontal upper strip 20 is integrally formed with the top edge 21 of strip 15.

For interconnecting the ends of cross support 14 with the side supports 11 and 12 by means of a lost motion connection, a support panel 22 is mounted or formed on each side support such as 11 and is arranged to project inwardly. Support panel 22 includes a transverse slot 23.

For cooperating with the transverse slot 23 in support panel 22, a downwardly projecting tab 24 is mounted on one or both ends of the first transverse panel 15. Since the length of slot 23 is substantially greater than the corresponding dimension of tab 24, a lost motion relationship is thus established between the ends of rear cross support 14 and side supports 11 and 12.

Figure 5:
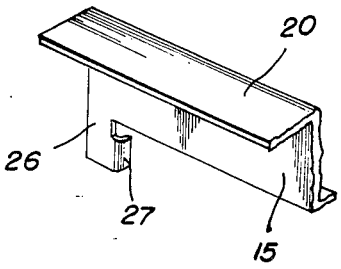
FIG. 5 is a view similar to FIG. 3 which shows a modification of a part thereof.

For aiding in preventing upward movement of rear cross support 14 relative to the side supports such as 11, the lower ends of tabs 24 may be bent out of the plane of the upper portion of tabs 24 as is shown in FIG. 4. If desired, the structure shown in FIG. 5 and including the tab 26 having the lateral projection 27 may be used instead of the bent tab 24 as shown in FIG. 4. In addition, a securing tab 25 is struck from and mounted on one or both ends of the second transverse panel 17 and as is shown in FIG. 4 is bent so that its upper end lies underneath the lower surface of support panel 22 thus further to aid in preventing upward movement of rear cross support 14 relative to the side supports such as 11.

The lost motion relation according to this invention may be used at one or both ends of the cross support 14 as is obvious.

INDUSTRIAL APPLICABILITY

According to this invention, a shelf for mounting primarily on gondola support posts is provided which is specially constructed to accommodate horizontal variations in the space between the gondola support posts, allowing the shelf to be used with a wide variety of existing gondolas. In addition, the shelf requires less vertical space then previous means of adapting flat gondola shelves to gravity.

We claim:

1. A display shelf for mounting on a pair of vertical spaced apart upright posts the spacing between which may vary somewhat, the shelf comprising a frame having front and back cross supports and a pair of side supports interconnected at their ends with the ends of said cross supports to form a rectangular frame and interconnected at their back ends respectively with said upright posts, an inwardly projecting support panel having a transverse slot and formed on at least one of said side supports adjacent the back end thereof, said back cross support being of stepped configuration and including a first transverse strip disposed in a vertical plane and extending between said side supports, and a downwardly projecting tab formed on the lower edge of said first transverse strip at at least one end thereof.

2. A display shelf according to claim 1 wherein a second transverse strip is disposed in an imaginary horizontal plane and having its rear edge integrally formed with the lower edge of said first transverse strip.

3. A display shelf according to claim 2 wherein said downwardly projecting tabs are struck from the rear corner of at least one end of said second transverse strip.

4. A display shelf according to claim 1 wherein the lower end of said downwardly projecting tab is bent out of the plane of the upper end thereof thereby to secure said back cross support against upward movement relative to said side supports.

5. A display shelf according to claim 1 wherein said downwardly projecting tab includes a lateral projection at the lower end thereof and engageable with the lower surface of said support panel.

6. A display shelf according to claim 2 wherein a third transverse strip is disposed in an imaginary vertical plane and having its upper edge integrally formed with the front edge of said second transverse strip and wherein a pair of securing tabs are struck from said third transverse strip adjacent the ends thereof respectively and arranged with parts thereof in engagement with the lower surface of said support panel so as to aid in preventing upward movement of said back cross support relative to said side supports.

7. In a display shelf, a junction between a side support and a cross support comprising a support panel projecting inwardly from said side support and supported thereby, a transverse slot formed in said support panel, a tab mounted on and projecting downwardly from said cross support and disposed within said transverse slot, the length of said transverse slot being substantially greater than the corresponding dimension of said tab whereby sidewise movement of said side support relative to said cross support is accommodated, and a securing tab mounted on said cross support and in engagement with the lower surface of said support panel to aid in preventing upward movement of said cross support relative to said side support.

* * * * *